US006736619B2

(12) United States Patent
Wu

(10) Patent No.: US 6,736,619 B2
(45) Date of Patent: May 18, 2004

(54) AIR PUMP WITH ROTATABLE DISCHARGE TUBE

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 0 days.

(21) Appl. No.: 10/199,677

(22) Filed: Jul. 22, 2002

(65) Prior Publication Data

US 2004/0013553 A1 Jan. 22, 2004

(51) Int. Cl.[7] ..... F04B 39/00; F04B 23/00; F04B 53/00; F04B 19/00

(52) U.S. Cl. ..... 417/572; 417/313; 417/238; 417/234

(58) Field of Search ..... 417/234, 238, 417/313, 572, 552

(56) References Cited

U.S. PATENT DOCUMENTS 4,272,228 A * 6/1981 Kutik et al. ..... 417/460
5,433,136 A * 7/1995 Lung-Po ..... 92/58.1
5,551,848 A * 9/1996 Chuang et al. ..... 417/437
5,624,242 A * 4/1997 Wu ..... 417/238
5,704,150 A * 1/1998 Milliman ..... 42/67
5,964,577 A * 10/1999 Chuang ..... 417/63

* cited by examiner

*Primary Examiner*—Justine R. Yu
*Assistant Examiner*—Timothy P. Solak
(74) *Attorney, Agent, or Firm*—Charles E. Baxley

(57) ABSTRACT

A foldable pump includes a cylinder, a first connector in communication with the cylinder, a second connector pivotally connected and communicated with the first connector, a tube in communication with the second connector and a nozzle in communication with the tube. The first connector may include a first tubular portion and a second tubular portion extending perpendicularly from and being in communication with the first tubular portion. The second connector may include a first tubular portion and a second tubular portion extending perpendicularly from and being in communication with the first tubular portion. The second tubular portion of the first connector is mounted on the cylinder. The first tubular portion of the first connector is pivotally connected and communicated with the first tubular portion of the second connector. The second tubular portion of the second connector is in communication with the tube.

9 Claims, 5 Drawing Sheets

AIR PUMP WITH ROTATABLE DISCHARGE TUBE

BACKGROUND OF INVENTION

1. Field of Invention

The present invention relates to a foldable pump.

2. Related Prior Art

There have been various manual pumps for bicycles. Generally, these pumps have to be small in size and light in weight. Some of these pumps are short. It is easy to carry a short pump. However, a rider has to bow or squat when using a short pump to inflate a tire. A rider may not have to bow or squat if using a long pump to inflate a tire. However, it is inconvenient to carry a long pump.

The present invention is therefore intended to obviate or at least alleviate the problems encountered in prior art.

SUMMARY OF INVENTION

It is the primary objective of the present invention to provide a foldable pump.

According to the present invention, a foldable pump includes a cylinder, a first connector in communication with the cylinder, a second connector pivotally connected and communicated with the first connector, a tube in communication with the second connector and a nozzle in communication with the tube.

The first connector may include a first tubular portion and a second tubular portion extending perpendicularly from and being in communication with the first tubular portion. The second connector may include a first tubular portion and a second tubular portion extending perpendicularly from and being in communication with the first tubular portion. The second tubular portion of the first connector is mounted on the cylinder. The first tubular portion of the first connector is pivotally connected and communicated with the first tubular portion of the second connector. The second tubular portion of the second connector is in communication with the tube.

The second connector may be inserted in the first connector. The second connector defines a transverse channel for communication with a channel defined in the first connector and an axial channel in communication with the transverse channel.

In an aspect, the foldable pump includes two annular seals mounted on the second connector on opposite sides of the transverse channel.

In another aspect, the second connector includes two annular ribs formed thereon on opposite sides of the transverse channel. The foldable pump may include two annular seals each mounted on one of the annular ribs.

A bolt may be inserted in the first connector for engagement with the second connector so as to retain the first connector connected with the second connector. The second connector may include an internal face formed with a thread. The bolt may include a thread formed thereon for engagement with the thread formed on the internal face of the second connector. An annular seal may be mounted on the bolt.

The second connector may be formed with a stop for avoiding excessive insertion thereof into the first connector.

The bolt may be formed with a stop for avoiding excessive insertion thereof into the first connector.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
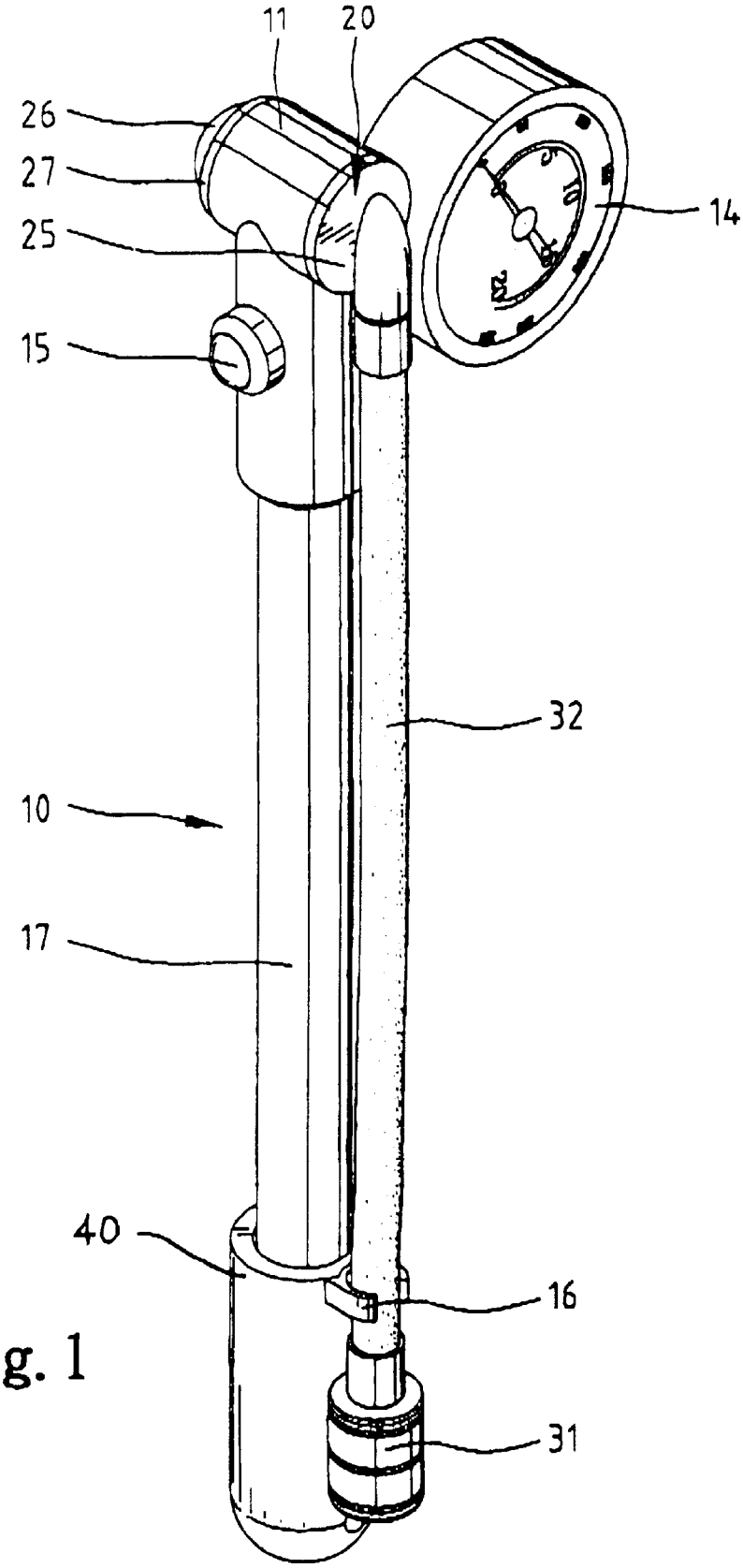
FIG. 1 is a perspective view of a foldable pump according to the present invention.

Referring to FIG. 1, according to the present invention, a foldable pump 10 includes an outside casing 17, a first connector 11, a second connector 20, a tube 32 and a nozzle 31.

Figure 2:
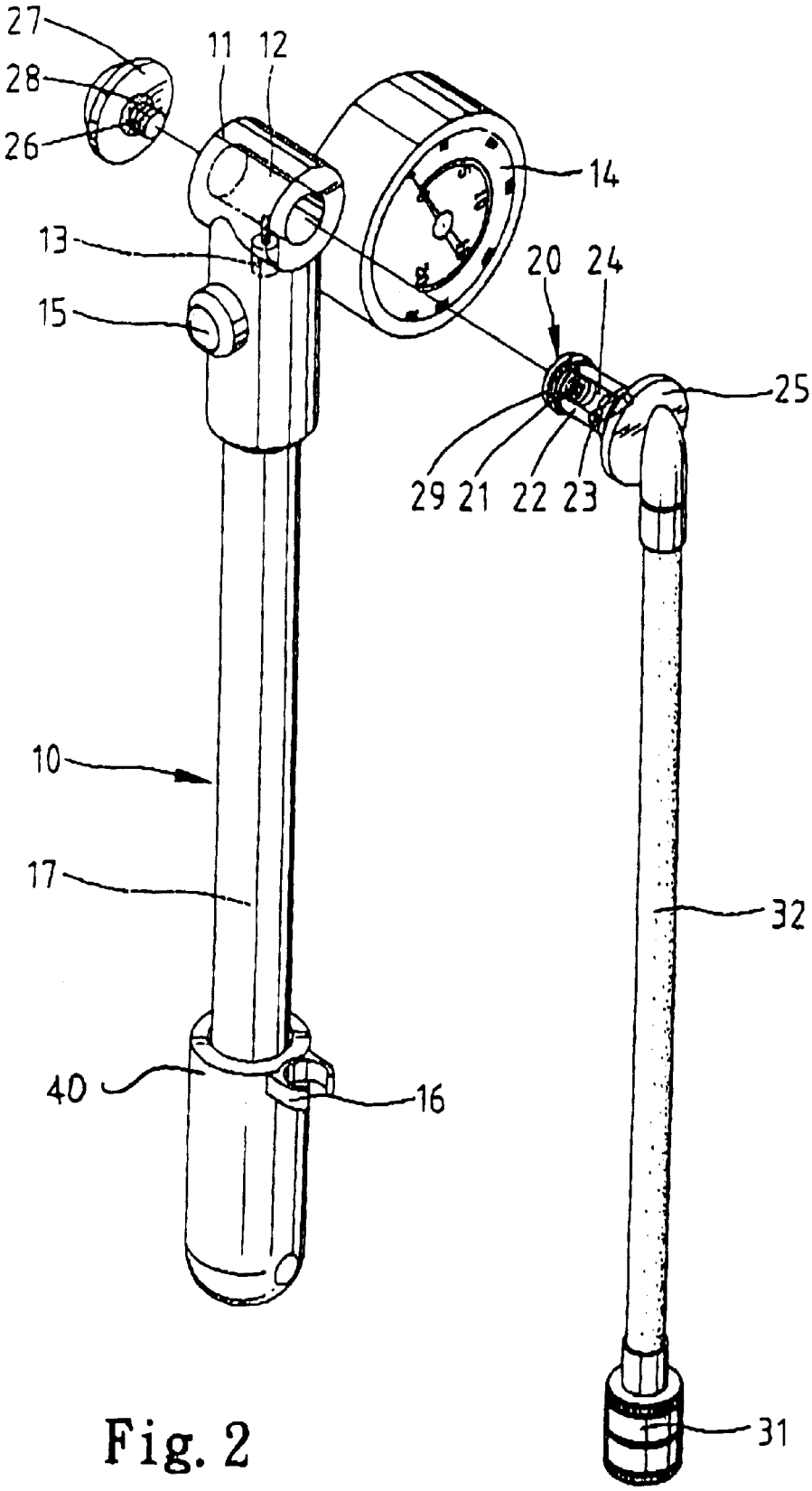
FIG. 2 is an exploded view of the foldable pump according to the present invention.

Referring to FIG. 2, the first connector 11 includes a first tubular portion and a second tubular portion extending perpendicularly from the first tubular portion. The first tubular portion of the first connector 11 defines a channel 12. The second tubular portion of the first connector 11 defines a channel 13. The channels 12 and 13 are in communication with each other. The second tubular portion of the first connector 11 is mounted on the outside casing 17. A pressure gauge 14 is mounted on the second tubular portion of the first connector 11. A release valve 15 is mounted on the second tubular portion of the first connector 11 for releasing air when necessary. A clip 16 is attached to the base 40 of the outside casing 17 for holding the tube 32 in position when the foldable pump 10 is not in use.

The second connector 20 includes a first tubular portion and a second tubular portion extending perpendicularly from the first tubular portion. Two annular seals 21 are respectively mounted on two separate annular ribs 29 formed on an external periphery 22 of the first tubular portion of the second connector 20. The first tubular portion of the second connector 20 defines a transverse channel 23 and an axial channel 24 in communication with the transverse channel 23. A stop 25 is formed on and around the external periphery of the first tubular portion of the second connector 20. A thread (not numbered) is formed on an internal face of the first tubular portion of the second connector 20.

A bolt 26 is formed together with a stop 27. A thread (not numbered) is formed on the bolt 26. An annular seal 28 is mounted on the bolt 26.

Figure 3:
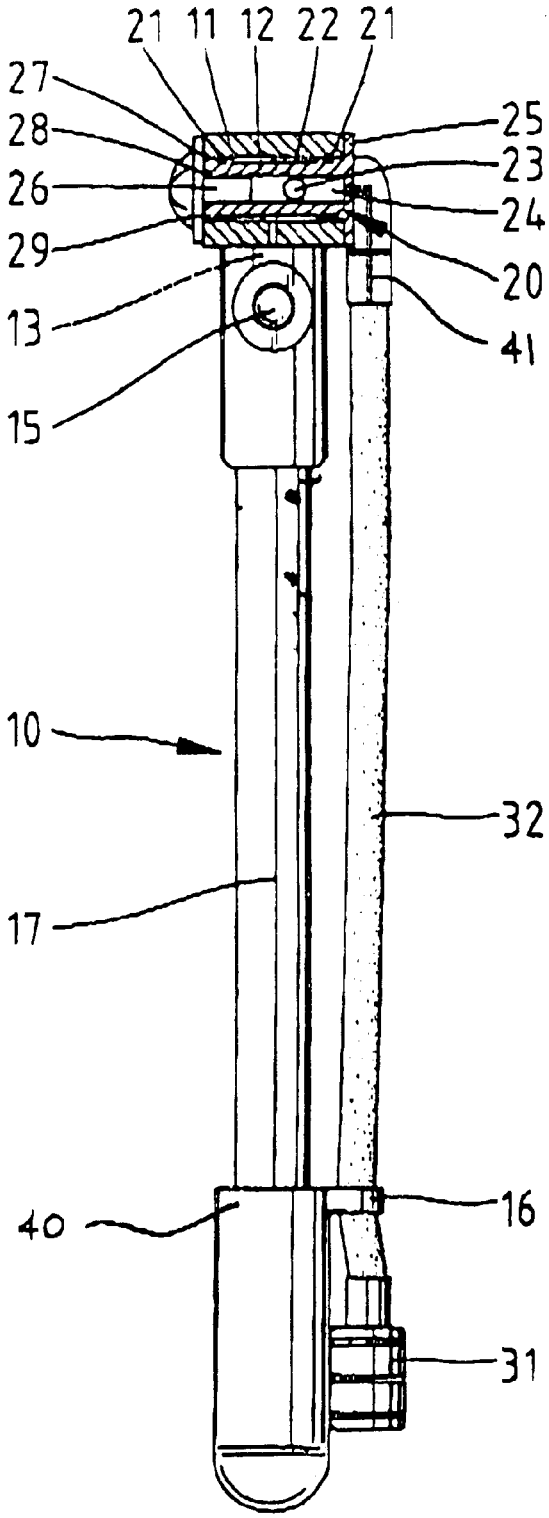
FIG. 3 is a cross-sectional view of the foldable pump according to this invention.

Referring to FIG. 3, the first tubular portion of the second connector 20 is inserted in the first tubular portion of the first connector 11. The annular seals 21 seal a gap defined between the external periphery of the first tubular portion of the second connector 20 and an internal face of the first tubular portion of the first connector 11. The bolt 26 is driven in the axial channel 24 defined in the first tubular portion of the second connector 20. The thread formed on the bolt 26 is engaged with the thread formed on the internal face of the first tubular portion of the second connector 20. The annular seal 28 seals any possible gap defined between the stop 28 and the first tubular portion of the second connector 20. The tube 32 includes an end connected with the second tubular portion of the second connector 20 and an opposite end connected with the nozzle 31. Thus, pressurized air can flow from outside casing 17 to the channel 13, from the channel 13 to the channel 12, from the channel 12 to the transverse channel 23, from the transverse channel 23 to the axial channel 24, from the axial channel 24 to a channel 41 defined in the tube 32. Therefore, the pressurized air can be pumped from the nozzle 31 to any article (not shown) in need of pumping.

Figure 4:
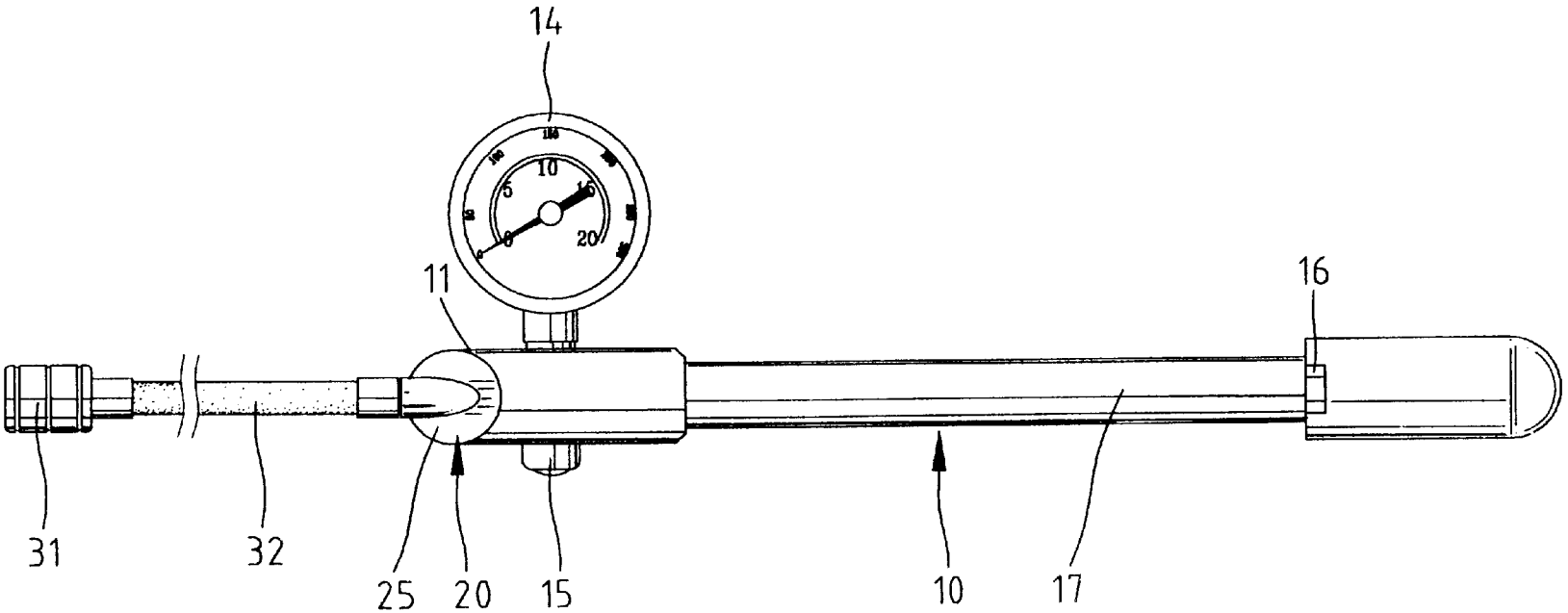
FIG. 4 is a side view of the foldable pump in a first position in use according to the present invention.
Figure 5:
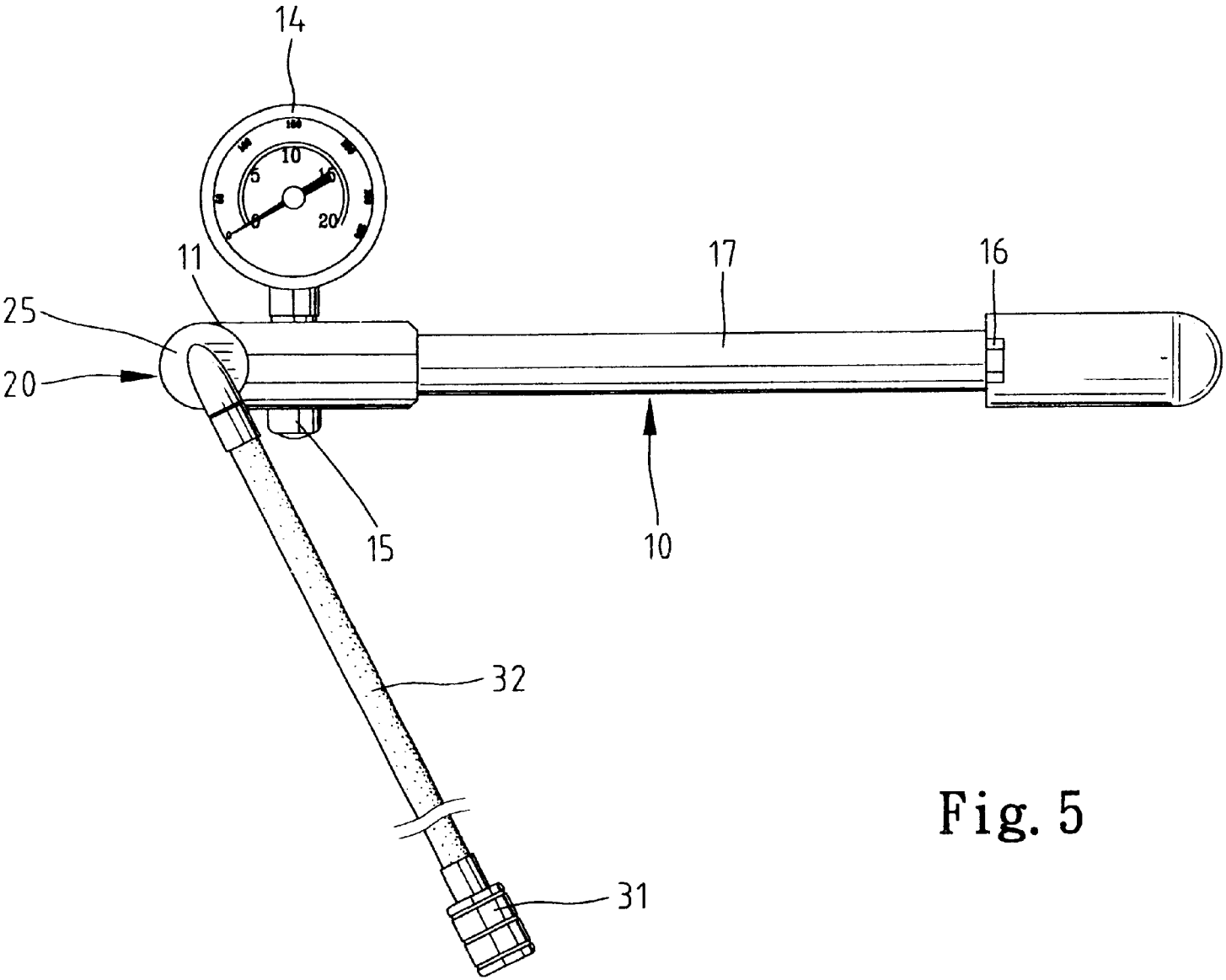
FIG. 5 is a side view of the foldable pump in a second position in use according to the present invention.

Referring to FIGS. 4 and 5, the tube 32 can be moved to various angular positions relative to the outside casing 17 in use. An adult can put the pipe 32 in a fully extended position relative to the outside casing 17 as shown in FIG. 4 so that he or she can easily use the foldable pump 10 to inflate a tire without a need to now or squat. A child can put the pipe 32 in a properly extended position relative to the outside casing 17 as shown in FIG. 5 so that he or she can easily use the foldable pump 10 to inflate a tire without a need to now or squat. A rider can put the pipe 32 in a folded position relative to the outside casing 17 as shown in FIG. 3 so that he or she can easily carry the foldable pump 10.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. An air pump with rotatable discharge tube comprising: an air pump cylinder, a first connector in communication with the cylinder, a second connector in communication with the first connector, a tube in communication with the second connector and a nozzle in communication with the tube, the second connector being in pivotal connection with the first connector between a fully extended position where the tube and the cylinder extend in opposite directions and a fully folded position where the tube is parallel to the cylinder; and the second connector is inserted in the first connector; wherein the second connector defines a transverse channel for communication with a channel defined in the first connector and an axial channel in communication with the transverse channel;

wherein the second connector includes two annular ribs formed thereon on opposite sides of the transverse channel including two annular seals each mounted on one of the annular ribs.

2. The air pump with rotatable discharge tube according to claim 1 wherein the first connector includes a first tubular portion and a second tubular portion extending perpendicularly from and being in communication with the first tubular portion, the first tubular portion of the first connector being connected and communicated with the second connector, the second tubular portion of the first connector being mounted on the cylinder.

3. The air pump with rotatable discharge tube according to claim 2 including a pressure gauge mounted on the second tubular portion of the first connector.

4. The air pump with rotatable discharge tube according to claim 1 wherein the second connector includes a first tubular portion and a second tubular portion extending perpendicularly from and being in communication with the first tubular portion, the first connector being pivotally connected and communicated with the first tubular portion of the second connector, the second tubular portion with the first tubular portion of the second connector being pivotally connected and communicated with the first connection of the second connector being in communication with the tube.

5. The air pump with rotatable discharge tube according to claim 1 wherein the first connector includes a first tubular portion and a second tubular portion extending perpendicularly from and being in communication with the first tubular portion, wherein the second connector includes a first tubular portion and a second tubular portion extending perpendicularly from and being in communication with the first tubular portion, wherein the second tubular portion of the first connector is mounted on the cylinder, and the first tubular portion of the first connector connected and communicated with the first tubular portion of the second connector, and the second tubular portion of the second connector is in communication with the tube.

6. The air pump with rotatable discharge tube according to claim 1 including a bolt inserted in the first connector for engagement with the second connector so as to retain the connection of the first connector with the second connector.

7. The air pump with rotatable discharge tube according to claim 6 wherein the second connector includes an internal face formed with a thread, wherein the bolt includes a thread formed thereon for engagement with the thread formed on the internal face of the second connector.

8. The air pump with rotatable discharge tube according to claim 6 wherein the bolt is formed with a stop for avoiding excessive insertion thereof into the first connector.

9. The air pump with rotatable discharge tube according to claim 1 wherein the second connector is formed with a stop for avoiding excessive insertion thereof into the first conenector.

* * * * *